United States Patent [19]

Mimura

[11] Patent Number: 5,020,180

[45] Date of Patent: Jun. 4, 1991

[54] WINDOW-PANE CLEANING DEVICE

[75] Inventor: Noritaka Mimura, Tokyo, Japan

[73] Assignee: Nihon Biso Co., Ltd., Tokyo, Japan

[21] Appl. No.: 526,117

[22] Filed: May 21, 1990

[30] Foreign Application Priority Data

May 25, 1989 [JP] Japan ..... 1-132382

[51] Int. Cl.[5] ..... A47L 1/00

[52] U.S. Cl. ..... 15/103; 15/250.11; 15/302

[58] Field of Search ..... 15/103, 50.1, 50.2, 15/50.3, 250.11, 320, 302

[56] References Cited

U.S. PATENT DOCUMENTS 4,198,724 4/1980 Fisher et al. ..... 15/103

4,800,607 1/1989 Fukutomi ..... 15/103

*Primary Examiner*—Edward L. Roberts

*Attorney, Agent, or Firm*—Hedman, Gibson, Costigan & Hoare

[57] ABSTRACT

A window-pane cleaning device for cleaning window-panes of a building is provided in a cleaning unit which is moved along a window of the building. The device includes a squeezee for cleaning a window-pane, an approaching and retraction servo device for moving the squeezee toward and away from the surface of the window-pane, an inclination angle adjusting servo device for adjusting the inclination angle of the squeezee, sensors for detecting the position and pressing force of the squeezee, and a control device responsive to detection outputs of the sensors for controlling the pressing force and inclination angle of the squeezee to predetermined values respectively at starting of cleaning, during continuous cleaning and finishing of cleaning.

10 Claims, 9 Drawing Sheets

WINDOW-PANE CLEANING DEVICE

BACKGROUND OF THE INVENTION

This invention relates to a window-pane cleaning device for cleaning window panes by using a squeezee and a method for controlling the same. The invention is directed to improving the cleaning efficiency drastically by employing a feedback control for controlling the squeezee in the pressing force applied thereto with two systems of servo devices.

As taller buildings are constructed, the number of windows provided in these buildings increases with accompanying necessity for regularly cleaning window-panes of these windows.

There has been a cleaning method currently in practice for cleaning window-panes according to which an operator in a moving scaffold hung from a roof of a building applies water on window-panes and wipes off water from the window-panes with a manually operated squeezee. This conventional cleaning method is inefficient and moreover is dangerous to the operator.

There has been developed a device for automatically cleaning window-panes. For example, as shown in FIG. 4, there is provided a cleaning unit 1 which is hung from a roof is capable of moving vertically. A squeezee 2 is mounted on this unit 1 such that the squeezee 2 abuts against a window-pane W and the fixing position of the squeezee 2 can be changed. Water is sprayed from a water spray nozzle 1 over the window-pane W and dust is wiped off with the squeezee 2 while the cleaning unit 1 is moved down. Soiled water is recovered and collected in a soiled water tank.

In such prior art window-pane cleaning device, it is necessary to press the squeezee 2 against the window-pane W with a constant force for effecting a satisfactory cleaning work without leaving an unwiped portion on the window-panes.

For this purpose, in the prior art cleaning device, the amount of projection of the squeezee 2 from the cleaning unit 1 is adjusted by changing the fixing position of the squeezee 2 before starting the cleaning work by moving down the cleaning unit 1.

Although the cleaning unit 1 of the prior art device is moved down along guides attached to the sides of each window of a building, there are irregularities in the mounting position of the guides and also mounting position of window-panes in each window due to errors in mounting these guides and window-panes. For this reason, the interval between the surface of the window-pane W and the cleaning unit 1 actually is not constant with resulting variation in the pressing force of the squeezee 2.

Hence, the squeezee 2 tends to be undesirably spaced away from the window-pane W as shown in FIG. 5*b* as compared to an optimum position shown in FIG. 5*a* or, conversely, approaches too close to the window-pane W as shown in FIG. 5*c* with resulting occurrence of unwiped portions on the window-panes W or increase in resistance to wiping by the squeezee 2 or leaving of scratches on the window-panes W.

Moreover, in a case where window-panes W continue horizontally and the cleaning operation must be made by moving the cleaning unit 1 in a horizontal direction, there are not only the above described error in mounting window-panes on windows but also a problem caused by a a window-pane with curved surface as shown in FIG. 5*d* provided in the corner portion of the building. In such curved portion of the window-pane, the distance between the surface of the window-pane W and the squeezee 2 varies inevitably with a result that an unwiped portion is left or, conversely, resistance in wiping increases.

In an attempt to overcome these problems, there has also been developed a cleaning device in which the amount of projection of the squeezee is adusted by stretching or withdrawing of arms of air cylinders. An expriment made with this cleaning device has made it clear that, as shown in FIGS. 6*a* and 6*b*, the pressing force of the squeezee in some case varies widely by a slight change in the amount of projection of the squeezee but in other case does not vary much despite a large change in the amount of projection of the squeezee, depending upon the state of contact of the squeezee against the surface of the window-pane. Thus, the relation between the pressing force of the squeezee and the amount of projection of the squeezee is not linear and, accordingly, the control system for adjusting the amount of projection of the squeezee by stretching or withdrawing air cylinders cannot improve the cleaning efficiency as expected.

It is, therefore, an object of the invention to provide a window-pane cleaning device and a method for controlling the same capable of cleaning window-panes by pressing a squeezee with a constant pressing force over the entire width of the window-pane notwithstanding variation in the distance between the squeezee and the window-pane whereby the cleaning efficiency can be remarkably improved.

It is another object of the invention to provide a method for controlling a window-pane cleaning device capable of controlling the squeezee always in an optimum condition during each period of starting cleaning, continuous cleaning and finishing cleaning.

SUMMARY OF THE INVENTION

The window-pane cleaning device for achieving the objects of the invention which is provided in a cleaning unit which is moved along a window of a building comprises a squeezee for cleaning a window-pane by pressing its foremost end corner portion against the surface of the window-pane, approaching and retraction servo means associated with said squeezee for moving said squeezee toward and away from the surface of the window-pane, inclination angle adjusting servo means associated with said squeezee for adjusting the inclination angle of said squeezee with respect to the surface of the window-pane, squeezee position detection means for detecting the current position of said squeezee, squeezee pressing force detection means for detecting the current pressing force of said squeezee against the surface of the window-pane, and control means responsive to detection outputs of said squeezee position detection means and said squeezee pressing force detection means for controlling the pressing force and the inclination angle of said squeezee to predetermined values respectively at starting of cleaning, during continuous cleaning and at finishing of cleaning.

According to the window-pane cleaning device of the invention, the approaching and retracting servo means for moving the squeezee toward and away from the surface of the window-pane and the squeezee angle adjusting servo means for adjusting the inclination angle of the squeezee with respect to the surface of the window-pane are provided. The position of the squeezee and the pressing force of the squeezee against the surface of the window-pane are detected, the pressing force and inclination angle of the squeezee during each period of starting cleaning, continuous cleaning and finishing cleaning are established by the control means, and the squeezee position is finely controlled by the feedback control based on the pressing force so as to control the pressing force within a predetermined range whereby the cleaning efficiency is improved.

According to the method for controlling the window-pane cleaning device of the invention, the pressing force and the inclination angle of the squeezee which can be moved toward and away from the surface of the window-pane at starting of cleaning, during continuous cleaning and at finishing of cleaning are controlled by a feedback control in accordance with results of detection of the position and the inclination angle of the squeezee so as to finely adjust the position of the squeezee and thereby maintain the pressing force of the squeezee within a predetermined range whereby the cleaning efficiency can be improved.

According to one aspect of the control method of the invention, a feedback control is made so that the corner portion of the squeezee is pressed against the surface of the window-pane accurately at starting of cleaning whereby an unwiped portion is not left on the window-pane.

According to another aspect of the control method of the invention, a feedback control is made so that a lower pressing force is established during continuous cleaning and the corner portion of the squeezee thereby is pressed against the surface of the window-pane accurately, since force applied to the squeezee is partly lost due to spraying of water, whereby the window-pane can be accurately wiped.

According to still another aspect of the invention, the squeezee is so controlled that it is retracted and its inclination angle is continuously increased so as to press the squeezee against the corner portion of the window-pane accurately and thereby prevent occurrence of an unwiped portion at finishing of cleaning.

A preferred embodimet of the invention will now be described with reference to the accompanying drawings.

BRIEF DESCRIPTION OF THE DRAWINGS

In the accompanying drawings.

DESCRIPTION OF A PREFERRED EMBODIMENT

Figure 1:
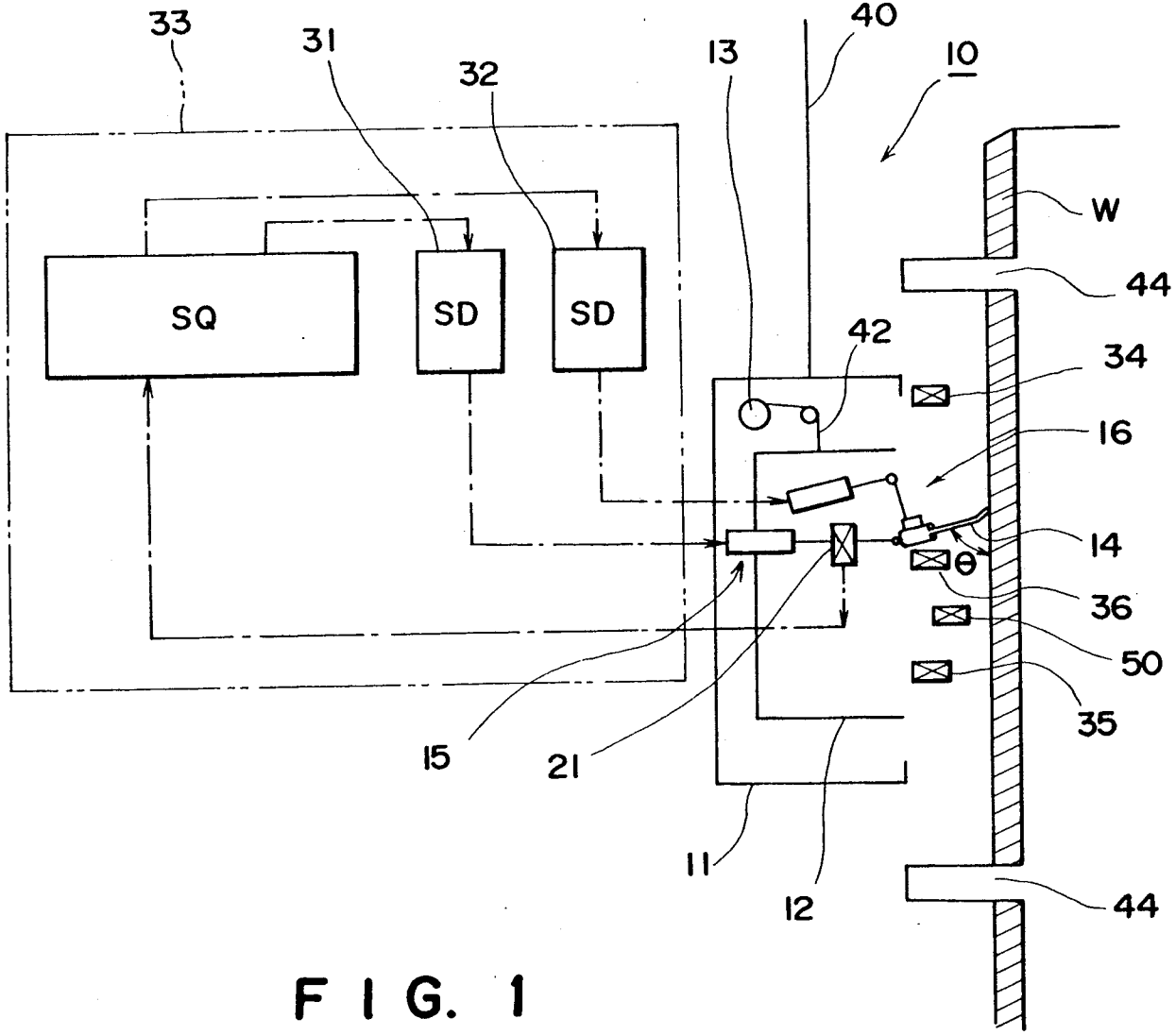
FIG. 1 is a schematic sectional view of an embodiment of the window-pane cleaning device according to the invention used for wiping window-panes in a vertical direction.

Referring to FIGS. 1 and 2, a window-pane cleaning device 10 of this embodiment of the invention is provided in a cleaning unit 11 which is displaceable to any desired location on a wall surface of a building on which a window-pane W is attached. In the illustrated example, the cleaning unit 11 which is capable of cleaning window-panes in a vertical direction is made of a horizontally oblong box suspended and moved vertically by a pair of wires 40 from a roof car provided displaceably on the roof of the building.

In a case where the invention is applied to a cleaning unit (not shown) for cleaning window-panes in a horizontal direction, the cleaning unit is made of a box capable of running horizontally along upper and lower rails provided along the upper and lower edges of window-panes W which continue in a horizontal direction.

The illustrated unit 11 for cleaning window-panes in a vertical direction is formed in its front surface with an opening of a length corresponding to the width of the window-pane W. In this opening is provide a head case 12 on which devices for cleaning window-panes are mounted. The head case 12 is vertically movable in the opening by means of a motor 13 and a wire 42 and it is possible, even during downward movement of the cleaning unit 11, to reduce a relative speed of the head case 12 with respect to the window-pane W to zero by lifting the head unit 12 by driving the motor 13.

A squeezee 14 is mounted on the head case 12 through an approaching and retraction servo device 15 for moving the squeezee 14 toward and away from the window-pane W and an inclination angle servo device 16 for adjusting the inclination angle of the squeezee 14 with respect to the surface of the window-pane W.

Figure 2A:
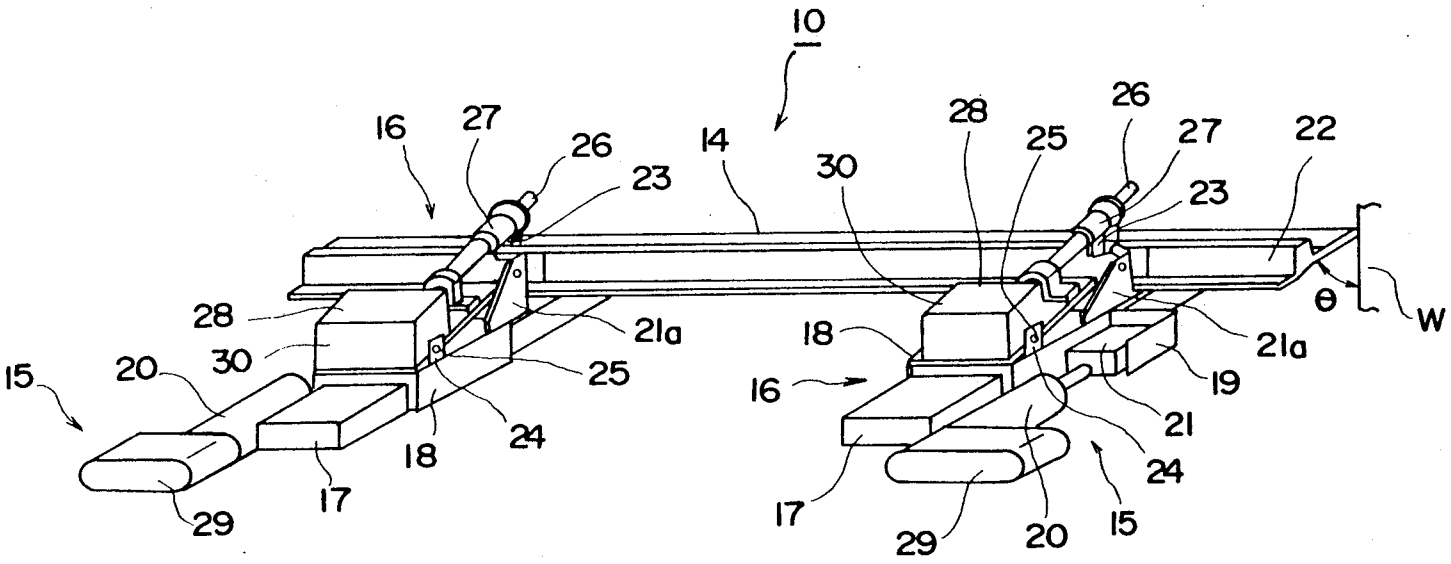
FIG. 2*a* is a perspective view of the squeezee unit used in this embodiment.

The approaching and retraction servo device 15 includes, as shown in FIG. 2*a*, a pair of guides 17 provided in the head case 12, a pair of slide tables 18 mounted slidably on the guides 17 in such a manner that these slide tables 18 are movable toward and away from the window-pane W. Servo motors 20 are connected to brackets 19 fixedly secured to the slide tables 18 via pressure sensors 21.

To each slide table 18 is pivotably connected base portions of a squeezee holder 22 through brackets 24. The squeezee 14 is secured to the squeeze holder 22 and arms 23 are integrally mounted on the upper side of the squeezee holder 22.

by reciprocating the slide tables 18 by driving the approaching and retraction servo motors 20, the squeezee holder 22 and hence the squeezee 14 can be moved toward and away from the surface of the window-pane W.

Figure 2B:
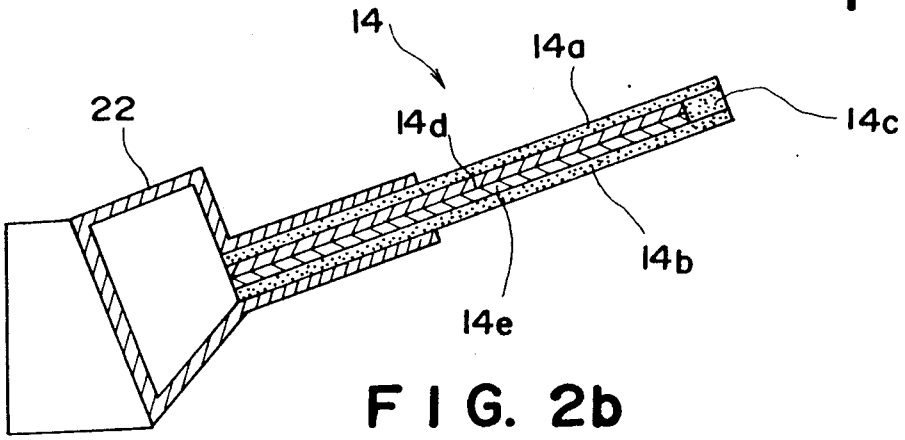
FIG. 2*b* is an enlarged cross-sectional view of the squeezee.

The squeezee 14 secured to the squeezee holder 22 may be made of a single rubber plate or, alternatively, may be a complex structure of rubber plates and elastic support plates made of synthetic resin as shown in an enlarged view of FIG. 2*b*.

The squeezee 14 of the complex structure shown in FIG. 2*b* is composed of three rubber plates 14*a*, 14*b* and 4*c* and two elastic support plates 14*d* and 14*e*. The rubber plates 14*a* and 14*b* are disposed on the upper and lower surfaces of the elastic support plates 14*d* and 14*e* and the rubber plate 14*c* having the same thickness as the thickness of the combined elastic support plates 14*d* and 14*e* is disposed at the foremost end of the elastic support plates 14*d* and 14*e*. These rubber plates 14*a*, 14*b* and 14*c* are bonded to the elastic support plates 14*d* and 14*e* but the elastic support plates 14*d* and 14*e* are not bonded to each other.

This squeezee 14 of a complex structure is substantially of the same size and shape as conventional squeezees. Since, however, the squeezee 14 includes the internal elastic support plates 14*d* and 14*e*, rigidity of the squeezee 14 as a whole is extremely high whereas the foremost end portion of the squeezee 14 is as soft as the conventional squeezees.

Since the elastic support plates 14*d* and 14*e* which are made of elastic synthetic resin are not bonded to each other, it has more flexibility than in a case where the elastic support plate is made of a single elastic synthetic resin plate while it maintains necessary rigidity.

Since the squeezee 14 of FIG. 2*b* is of the complex structure described above, it is not necessary to adjust rigidity and flexibility of the squeezee 14 by the amount of projection of the squeezee 14 from the squeezee holder 22. Besides, since the squeezee 14 has a high rigidity owing to the provision of the elastic support plates 14*d* and 14*e*, the squeezee 14 can be mounted in a straight line as viewed in its cross section without the foremost end portion of the squeezee 14 hanging down.

Since the aforemost end portion of the squeezee 14 does not hang down as described above, it is possible to apply the edge of the squeezee 14 uniformly to the surface of the window-plane W from the start of cleaning work.

Since the elastic support plates 14*d* and 14*e* are inserted inside of the rubber plates 14*a*, 14*b* and 14*c*, these elastic support plates 14*d* and 14*e* are covered with rubber so that damage to the squeezee 14 can be prevented when the squeezee 14 abuts accidentally against the wall surface of the building.

Besides, since the rigidity of the squeezee 14 is high, deformation of the squeezee 14 due to reaction hardly occurs during cleaning so that the squeezee 14 can be used for cleaning in a highly stable condition.

A pair of elastic support plates are preferably used for the squeezee 14 but a single elastic support plate or a plurality of elastic support plates may also be used.

Figure 2C:
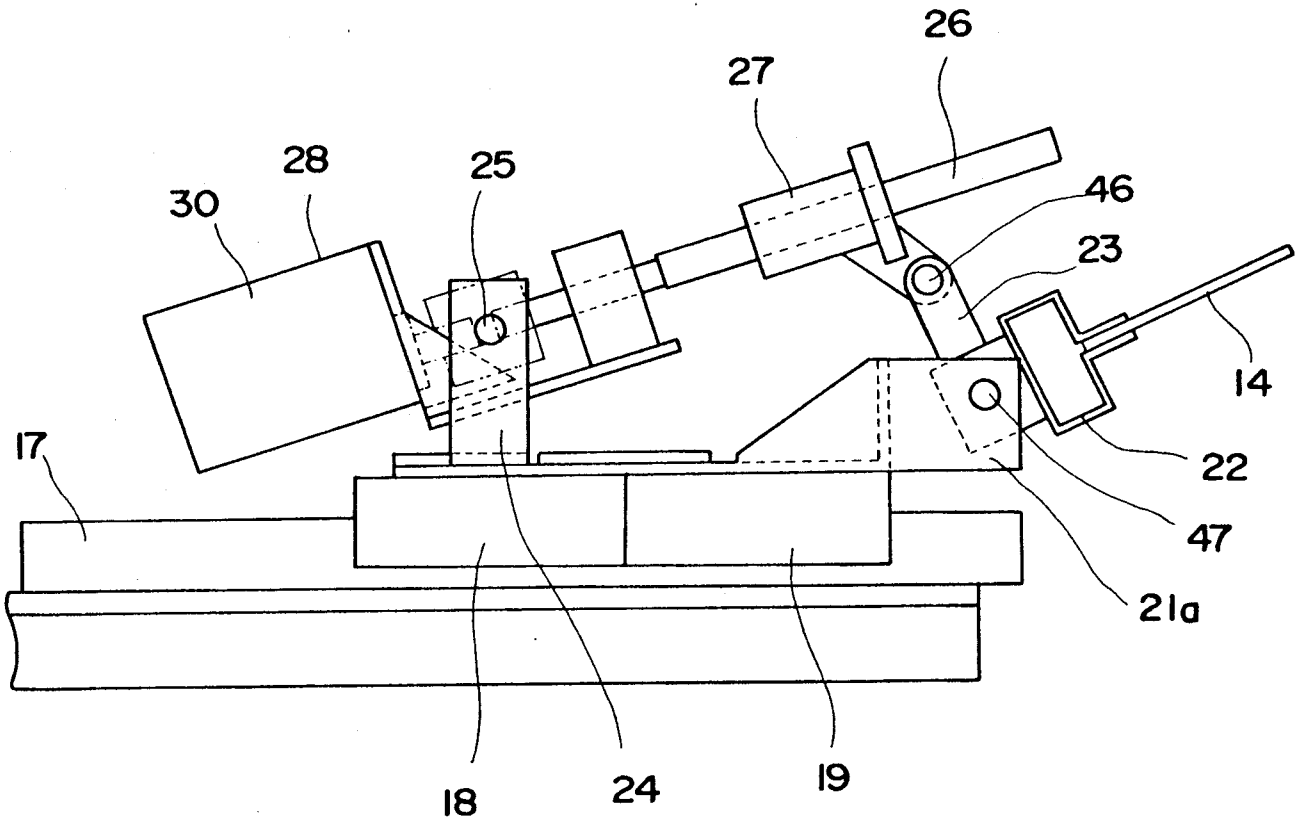
FIG 2*c* is an enlarged side view of the approaching and retraction servo device and the angle adjusting servo device.

The angle adjusting servo device 16 which are shown in FIGS. 2*a* and 2*c* includes brackets 24 provided at the base portions of the slide tables 18, ball screws 26 pivotably secured to these brackets 24 by means of pins 25, ball nuts 27 in threaded engagement with the ball screws 26 and connected to the arms 23 of the squeezee holder 22 by means of pins 46 and angle adjusting servo motors 28 connected to the ball screws 26.

By rotating the ball screws 26 by rotation of the servo motors 28, the ball nuts 27 are displaced along the ball screws 26 and therefore the inclination angle of the squeezee holder 22 with respect to the window-pane W can be adjusted through the pins 46, arms 23 and pins 47. The pins 46 and 47 extend parallel to the surfacne of the window-pane.

Encoders 29 and 30 are provided on the approaching and retraction servo motor 20 and the angle adjusting servo motor 28 for detecting the amount of approaching and retraction and the angle of inclination from respective numbers of rotation.

A control device 33 includes servo drivers 31 and 32 for the approaching and retraction servo motor 20 and the angle adjusting servo motor 28. The pressure sensors 21 are connected to the control device 33. Thus, the control device 33 inputs and outputs detection signals of the pressing force of the squeezee 14 and feedback control signals.

The control device 33 further receives detection signals from two detection sensors 34 and 35 mounted in the cleaning unit 11 and made, for example, of photoelectric sensors for detecting window frames 44 attached to the windows and a window-pane approaching detection sensor 36 for detecting approaching of the squeezee 14 to the surface of the window-pane W.

The control device 33 performs a feedback control for establishing a high pressing force B of the squeezee 14 at the start of cleaning, establishing a low pressing force C of the squeezee 14 during continuous cleaning and withdrawing and inclination angle setting of the squeezee 14 for wiping a corner portion of the window-pane W at finishing of cleaning.

In addition to the above described squeezee 14 connected to the approaching and retraction servo device 15 and the angle adjusting servo device 16, there are also provided in the head case 12 of the cleaning unit 11 a water spray unit, a soiled water collection device and other known devices (not shown).

Figure 3A:
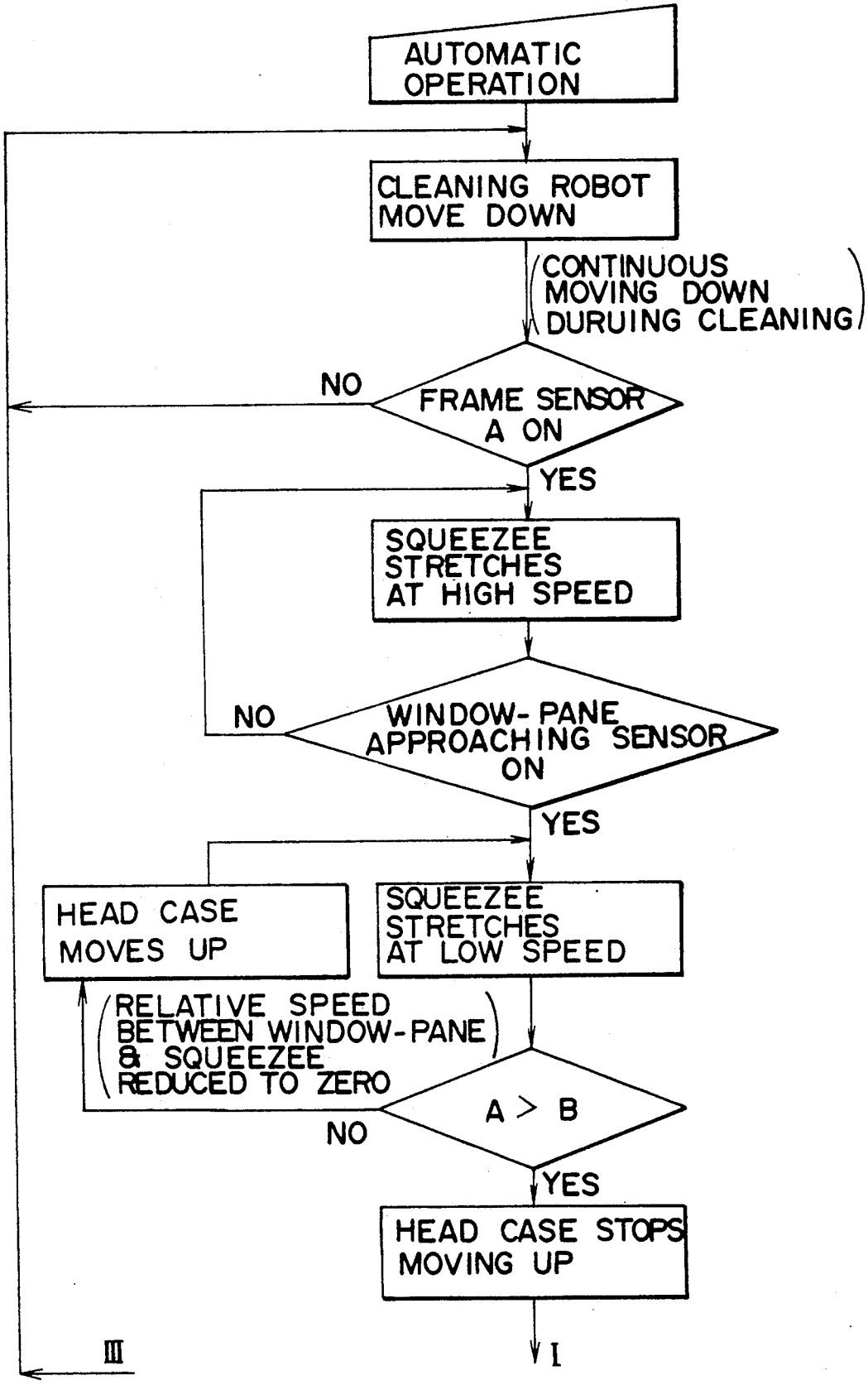
FIG. 3 is a flow chart showing an example of the method for controlling the window-pane cleaning device according to the invention.
Figure 3B:
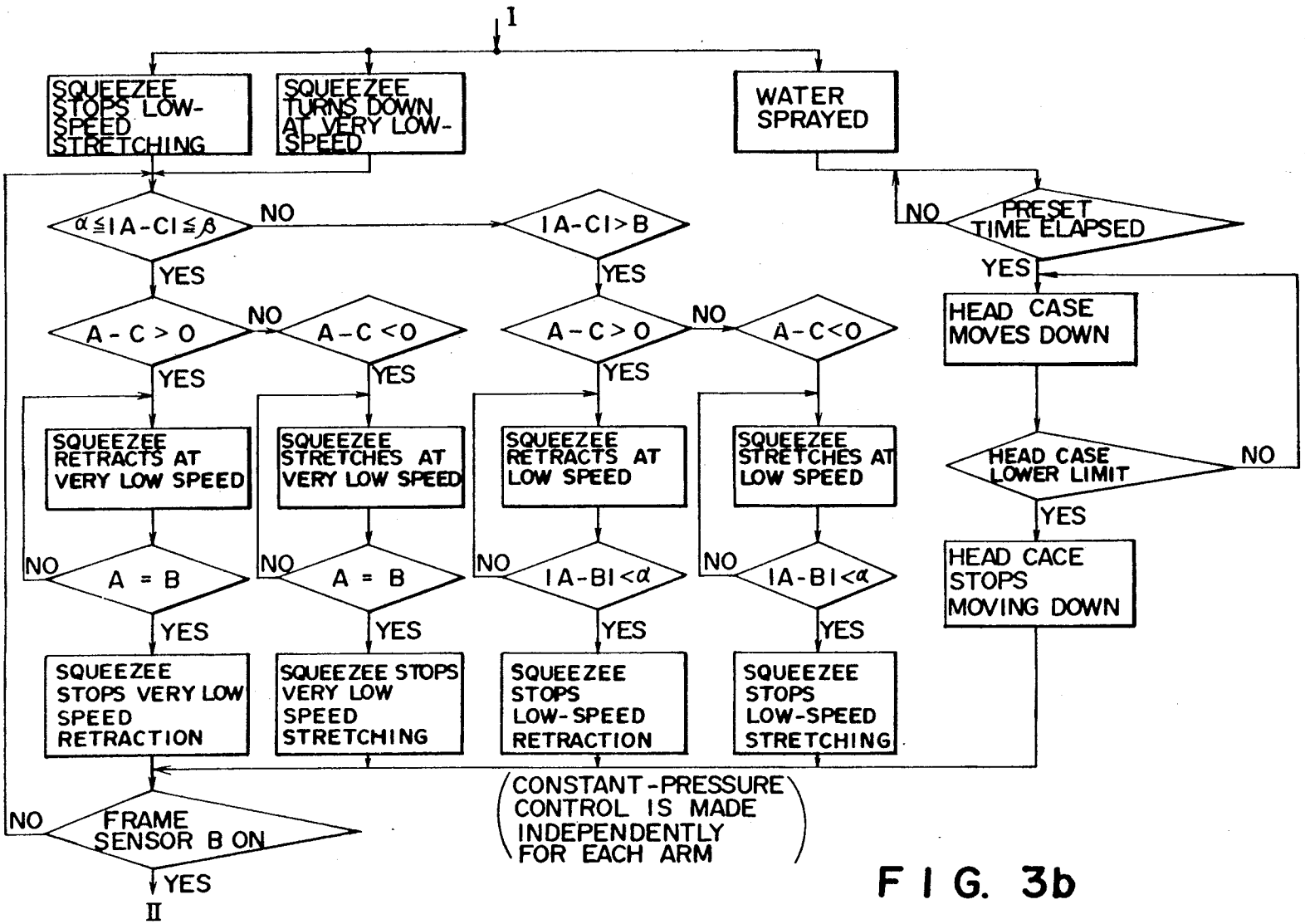
Figure 3C:
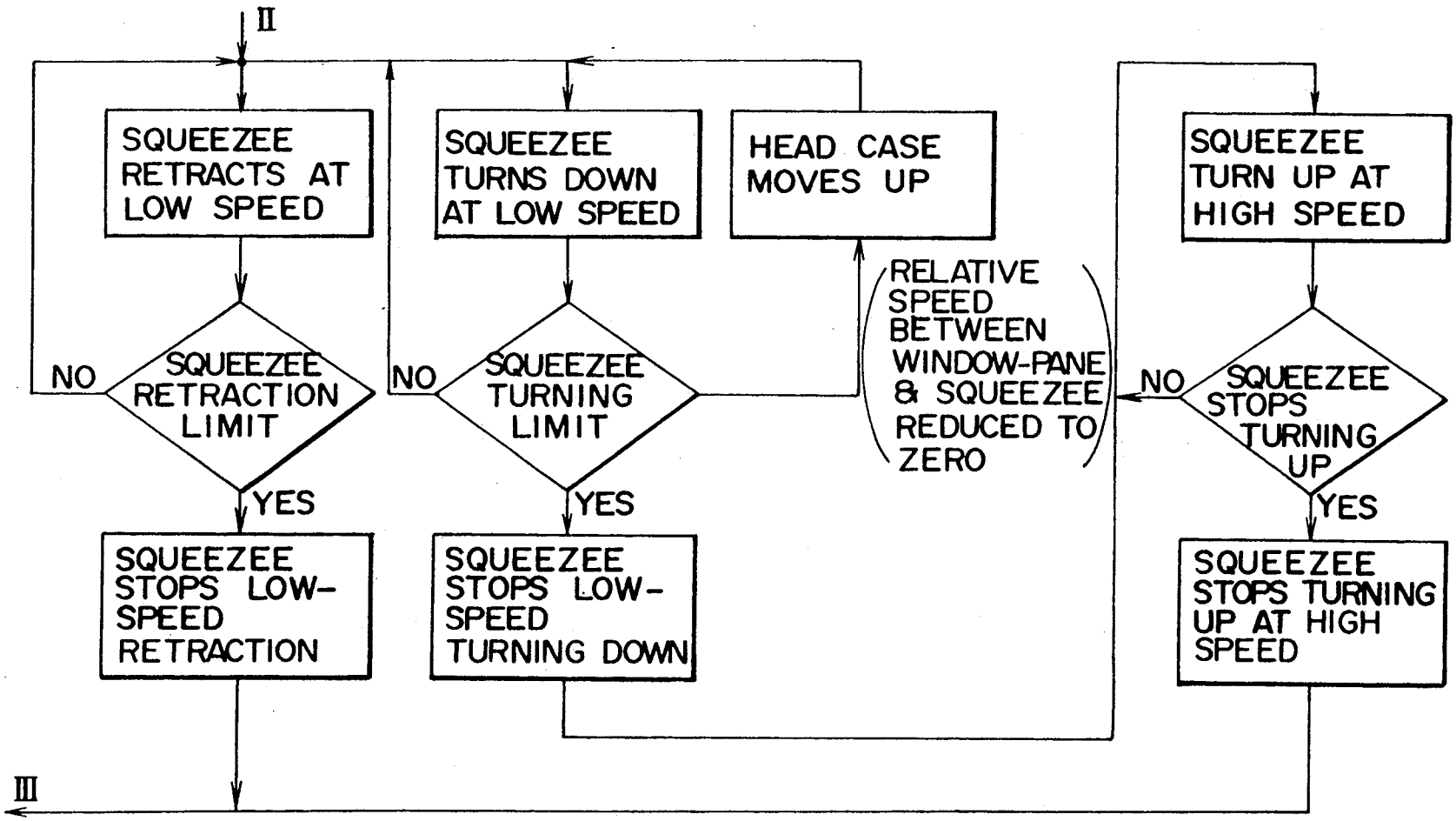
Figure 4:
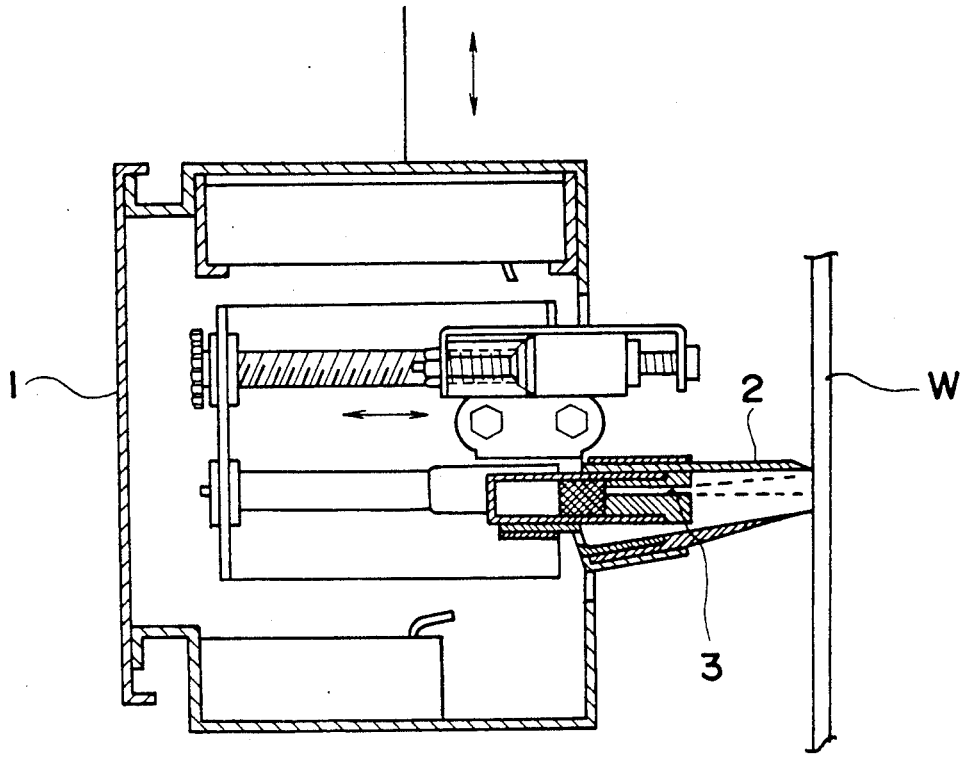
FIG. 4 PRIOR ART
FIG. 4 is a cross-sectional view of a prior art window-pane cleaning device.
Figure 5A:
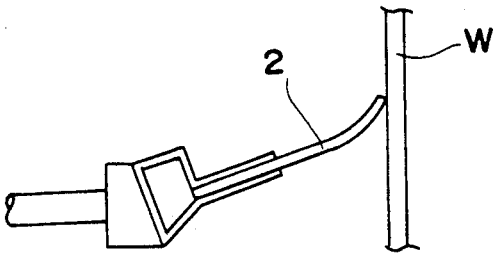
FIGS. 5*a* to 5*d* are views for showing the squeezee positions in the cleaning operation by the prior art device.
Figure 5B:
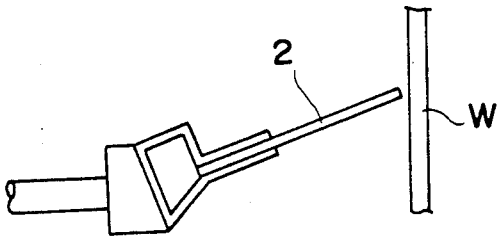
Figure 5C:
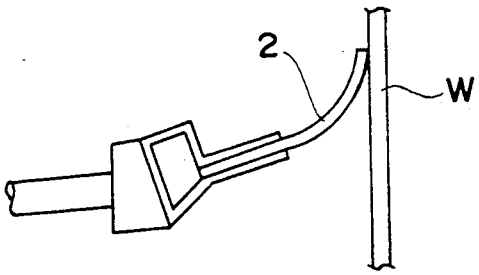
Figure 5D:
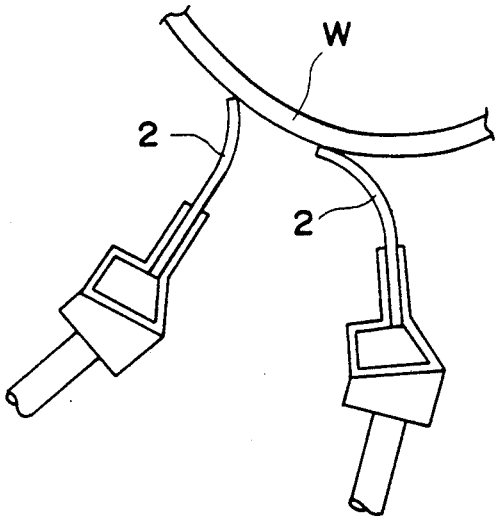
Figure 6A:
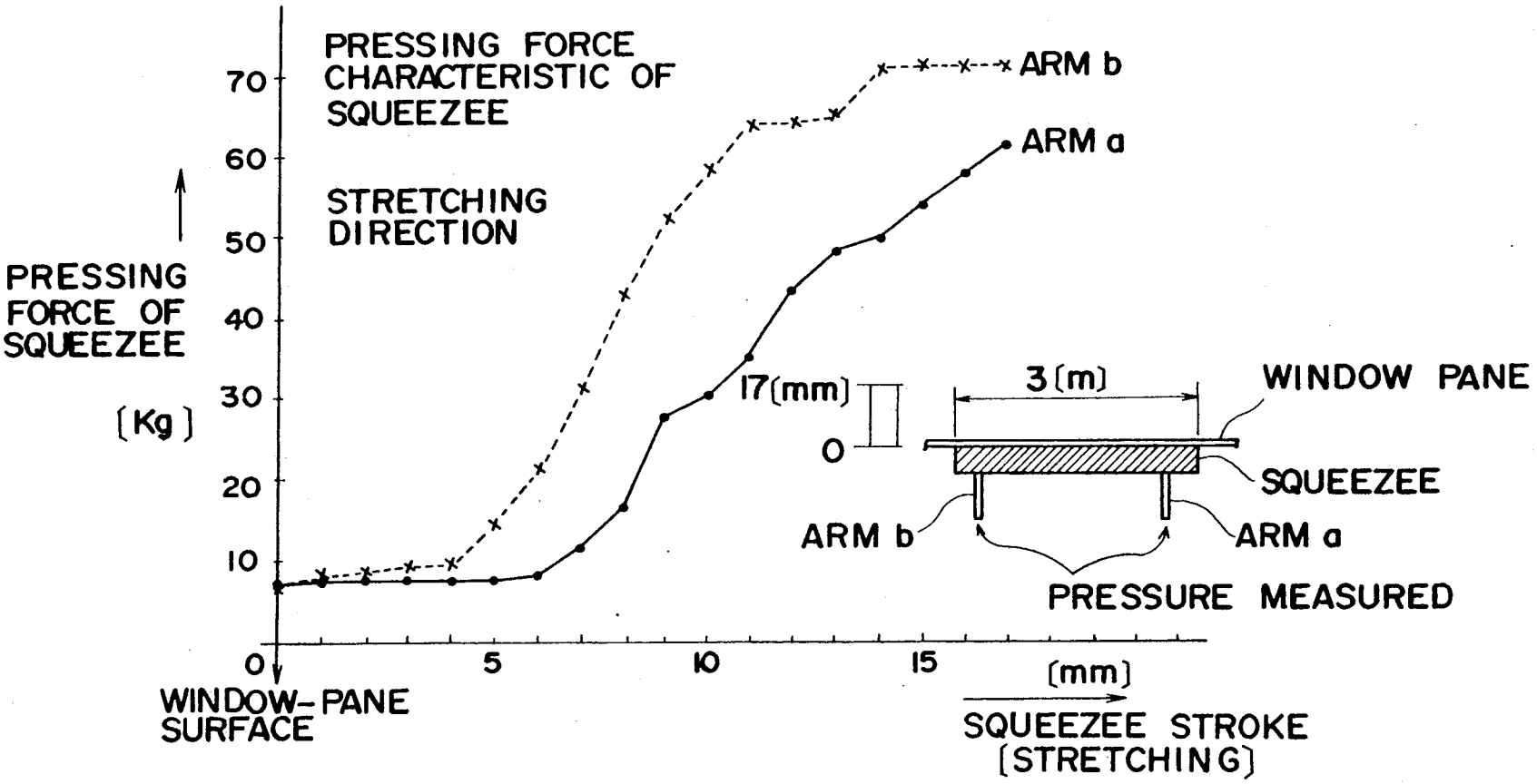
FIGS. 6*a* and 6*b* are graphs showing the relation between the amount of displacement of the squeezee and the pressing force.
Figure 6B:
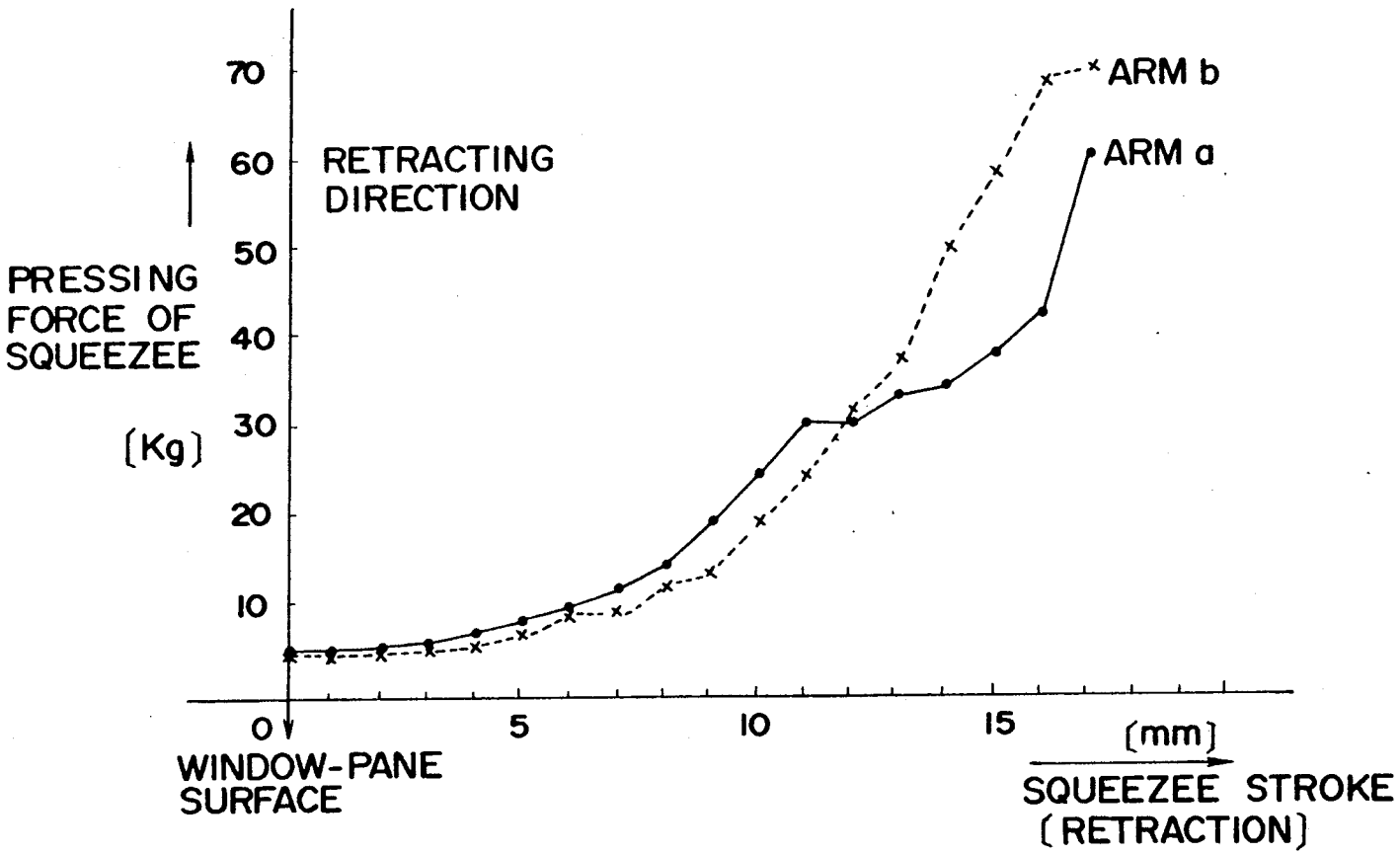

The operation of the above described window-pane cleaning device 10 and the method for controlling this device 10 will now be described with reference to the flow chart of FIG. 3.

(1) First, the window-pane cleaning device 10 is hung from a roof car provided on the roof of a building and preparations for the window-pane cleaning work such as preparation for the water spray device are made.

(2) After completion of the necessary preparations, a switch for issuing a command for the automatic operation of the control device 33 is turned on. The cleaning unit 11 thereupon starts moving downwardly.

(3) The upper frame detection sensor 34 is turned on by the downward movement of the cleaning unit 11 and thereupon the approaching and retraction sevo motor 20 is rotated at a high speed to cause the squeezee 14 to stretch at a high speed toward the window-pane W until the window-pane approaching detection sensor 36 has detected approaching of the squeezee 14 to the surface of the window-pane W and thereby is turned on.

(4) As the window-pane approaching detection sensor 36 has been turned on, the stretching speed of the squeezee 14 is switched to a low speed. An acutal pressing force A of the squeezee 14 supplied from the pressure sensor 21 is compared with a set value B of the pressing force of the squeezee 14 at starting of cleaning. While the actual value A is smaller than the set value B, the head case 12 is moved upwardly in the cleaning unit 11 to reduce the relative speed of the squeezee 14 with respect to the window-pane W to zero and thereby preventing the squeezee 14 from starting the cleaning work of the window-pane W by the downward movement.

The value B of the pressing force of the squeezee 14 at starting of cleaning is set at a higher value than the pressing force C during continuous cleaning for the purpose of ensuring abutment of the foremost end corner portion of the squeezee 14 against the surface of the window-pane W. For example, the set value B is about 50% higher than the pressing force C during the continuous cleaning.

(5) Upon reaching of the actual pressing force A of the squeezee 14 to the set value B, the upward movement of the head case 12 is stopped.

(6) Upon stopping of the upward movement of the head case 12, the squeezee 14 is moved down as the cleaning unit 11 is moved down and cleaning of the window-pane W is started.

Simultaneously with start of cleaning, the low-speed stretching of the squeezee 14 is stopped and adjustment of the inclination angle of the squeezee 14 is made at a very low speed for increasing the angle of the squeezee 14 with respect to the window-pane W (FIG. 2*a*). Spraying of water by the spray device is also started.

(7) Upon starting of cleaning, the working mode of the squeezee 14 is changed from the cleaning start mode to the continuous cleaning mode.

More specifically, the set value of the pressing force of the squeezee 14 is changed to the set value C for the continuous cleaning mode. This set value C and the actual value A are compared with each other and whether difference between these values is within an allowable error range ($\alpha$, $\beta$) of the pressing force or not is judged. If this difference is within the allowable error range, a control is made so that the actual value A coincides with the set value C by stretching or retraction of the squeezee 14 at a very low speed. If the difference is out of the allowable error range, a control is made so that the actual value A coincides with the set value C by stretching or retraction of the squeezee 14 at a low speed (a higher speed than "very low speed" so that the set value will be reached at the minimal length of time).

As the allowable error range ($\alpha$, $\beta$), a range of about 7.5% of the set value C of the pressing force of the squeezee 14 is preferable.

The above described feedback control for making the pressing force of the squeezee 14 constant is continuously performed by the approaching and retracting servo device 15 until a lower frame of the window-pane has been detected by the frame detection sensor 35 mounted on the lower surface of the cleaning unit 11.

(8) Water is sprayed over the window-pane W simultaneously with start of cleaning by the squeezee 14. Upon lapse of a predetermined period of time after start of cleaning, the head case 12 is moved downwardly in preparation for wiping of the lower end portion of the window-pane W. The downward movement of the head case 12 is stopped when the head case 12 has reached the lowermost end of the window-pane W.

(9) Thus, the feedback control is made so as to maintian the pressing force of the squeezee 14 constant and, upon detection by the frame detection sensor 35 of the lower frame of the window-pane W, the squeezee 14 is brought into the cleaning finish mode.

In this mode, the squeezee 14 is retracted at a low speed and, simultaneously, is turned down at a low speed so as to increase the angle $\theta$. The pressing force of the squeezee 14 is simultaneously controlled so that it will become a value within an allowable error range of the set value C. Simultaneously with the control in the cleaning finish mode, the head case 12 is moved upwardly to reduce the relative speed between the squeezee 14 and the window-pane W to zero.

By these operations, the corner portion of the window-pane W can be completely wiped out and cleaned.

(10) Upon retraction and turning down of the squeezee 14 to the fullest extent, retraction and angle adjustment of the squeezee 14 are finished.

(11) Then, the squeezee 14 is turned up at a high speed for overriding the lower frame and stopped at the fully turned up position. Simultaneously, spraying of water by the water spray device is stopped. The head case 12 is moved down for preparing for cleaning of a next window-pane W.

(12) By repeating the operations (1) through (12), window-panes W of the building are continuously cleaned in the vertical direction. After completing cleaning of the lowermost window-pane W, the roof car is moved horizontally to a next row of window-panes and cleaning of the window-panes of the next row is made starting from the uppermost window-pane W. In this manner, all window-panes W of the building can be cleaned.

According to the above described window-pane cleaning device 10 and the method for controlling the same, the pressing force of the squeezee 14 is constantly measured by the pressure sensors 21 and detection signals from the pressure sensors 21 are fed back to the approaching and retraction servo device 15 and the angle adjustment servo device 16 which constitute the drive servo system for the squeezee 14 so that a fine position control in the order of millimeters can be made. Accordingly, the pressing force of the squeezee 14 can be maintained constantly within a certain range and this contributes to drastic improvement in the cleaning operation as compared to the prior art device according to which distance between the squeezee 14 and the window-pane W is maintained at a constant value.

According to the present invention, at starting of cleaning, the squeezee 14 is controlled at a high pressing force and a large inclination angle to ensure that the foremost end corner portion of the squeezee 14 abuts against the surface of the window-pane W. Then, the pressing force and inclination angle of the squeezee 14 is set to values for the continuous cleaning mode and, at finishing of cleaning, the squeezee 14 is retracted and turned down. Accordinly, a complete cleaning can be achieved with a single squeezee.

Since the stroke (i.e., the amount of approaching and retraction) of the squeezee 14 is determined by the pressing force thereof against the window-pane W, the squeezee 14 can follow the contour of the window-pane W completely despite existence of recesses and depressions or bent portions on the surface of the window-pane W so that complete cleaning can be realized without giving rise to an unwiped portion.

Since the set values of the sequence program of the control device 33 can be changed as desired, the same program can be applied to various types of window-panes W.

Since the speed of stretching and retraction of the squeezee 14 can be changed among the very low speed, low speed and high speed and the value of each speed can be varied as desired, a shock to the window-pane W caused by squeezee 14 can be eliminated.

Since the speed of changing the inclination angle of the squeezee 14 can also be changed among the very low speed, low speed and high speed and the value of each speed can be varied as desired, a corner portion of the window-pane W can be completely cleaned.

Since the device has an excellent follow-up characteristic, accuracy of repetition is satisfactory and, accordingly, necessity for adjustment of the device in the working location is reduced remarkably.

Since an electrical system using an electric motor is adopted as the control system, a pneumatic system is obviated with resulting simplification of the device and reduction in noise owing to obviating of an air compressor.

If the squeezee 14 of the complex structure is used as the squeezee, adjustment during mounting of the squeezee to the squeezee holder is facilitated and accurate abutment of the foremost end corner portion of the squeezee against the surface of the window-pane is ensured with resulting improvement in cleaning efficiency.

In the above described embodiment of the window-pane cleaning device, the respective controls of the squeezee at starting of cleaning, during continuous cleaning and at finishing of cleaning are combined together. However, any of these controls may be selectively combined.

Instead of providing a single squeezee ranging over the entire width of the window-pane to be cleaned, a plurality of squeezees which are divided in the direction of the width of the window-pane may be employed.

The approaching and retraction device for the squeezee is not limited to the above described embodiment using the guides and slide tables but other reciprocating mechanisms such as a feed screw, gear wheels and rotary reciprocating means such as a cam may also be used.

The direction of cleaning by the squeezee is not limited to the vertical direction but the invention is applicable to cleaning in the horizontal direction.

As the pressure sensors, any suitable type of sensor may be utilized and the position at which the pressure sensors are provided may be any position at which the pressing force of the squeezee can be detected.

Other mechanisms necessary for the cleaning operation may be selected as desired. The component elements of the invention may also be substituted within the spirit and scope of the invention.

What is claimed is:

1. A window-pane cleaning device provided in a cleaning unit which is moved along a window of a building comprising:

a squeezee for cleaning a window-pane by pressing its foremost end corner portion against the surface of the window-pane;

approaching and retraction servo means associated with said squeezee for moving said squeezee toward and away from the surface of the window-pane;

inclination angle adjusting servo means associated with said squeezee for adjusting the inclination angle of said squeezee with respect to the surface of the window-pane;

squeezee position detection means for detecting the current position of said squeezee;

squeezee pressing force detection means for detecting the current pressing force of said squeezee against the surface of the window-pane; and control means responsive to detection outputs of said squeezee position detection means and said squeezee pressing force detection means for controlling the pressing force and the inclination angle of said squeezee to predetermined values respectively at starting of cleaning, during continuous cleaning and at finishing of cleaning.

2. A window-pane cleaning device as defined in claim 1 wherein said squeezee is composed of an inner elastic support plate made of synthetic resin and outer rubber plates covering the inner elastic support plate.

3. A window-pane cleaning device as defined in claim 2 wherein said inner elastic support plate is composed of two elastic plates which are not bonded to each other and said outer rubber plates are bonded to said inner elastic support plates.

4. A window-pane cleaning device as defined in claim 1 wherein said approaching and retraction device comprises a pair of guides, a pair of slide tables mounted slidably on said guides in such a manner that said slide tables are movable toward and away from the window-pane, servo motors connected to said slide tables for driving said slide tables, and pressure sensor means for detecting the pressing force of said squeezee and supplying their detection outputs to said servo motors.

5. A window-pane cleaning device as defined in claim 1 wherein said inclination angle adjusting servo means comprises squeezee pivoting means for pivoting said squeezee about pins extending parallel to the surface of the window-pane and servo motors connected to said squeezee pivoting means for driving said squeezee pivoting means.

6. A window-pane cleaning device as defined in claim 5 wherein said squeezee pivoting means comprises ball screws pivotably mounted on said approaching and retraction servo means and ball nuts in threaded engagement with said ball screws and pivotably connected to said squeezee.

7. A method for controlling the window-pane cleaning device as defined in claim 1 comprising steps of:

detecting the position of said squeezee and the pressing force of said squeezee; and performing a feedback control in accordance with results of detection for bringing the pressing force and inclination angle of said squeezee to predetermined values respectively at starting of cleaning, during continuous cleaning and finishing of cleaning.

8. A method as defined in claim 7 wherein said squeezee is pressed against the window-pane with a predetermined high pressing force and at a predetermined large inclination angle at starting of cleaning.

9. A method as defined in claim 7 wherein said squeezee is pressed against the window-pane with a pressing force within a predetermined range during continuous cleaning.

10. A method as defined in claim 7 wherein the inclination angle of said squeezee against the window-pane is continuously made larger while said squeezee is retracted so as to clean a corner portion of the window-pane at finishing of cleaning.

* * * * *